United States Patent [19]

Chesnut

[11] Patent Number: 4,901,463

[45] Date of Patent: Feb. 20, 1990

[54] CARTRIDGE MAGAZINE HAVING A SINGLE PIECE MAGAZINE HEAD

[76] Inventor: M. Gaines Chesnut, 1171 Barlow Dr., Kremmling, Colo. 80459

[21] Appl. No.: 116,035

[22] Filed: Oct. 29, 1987

[51] Int. Cl.[4] ..... F41C 25/02

[52] U.S. Cl. ..... 42/50

[58] Field of Search ..... 42/50 APS

[56] References Cited

U.S. PATENT DOCUMENTS

| | | | |
|---|---|---|---|
| 3,577,860 | 5/1971 | Jestrabek | 42/50 |
| 4,127,954 | 12/1978 | Hausmann | 42/50 |
| 4,472,900 | 9/1984 | Howard | 42/50 |
| 4,566,212 | 1/1986 | Chesnut | 42/50 |

*Primary Examiner*—Charles T. Jordan

*Attorney, Agent, or Firm*—Sheridan, Ross & McIntosh

[57] ABSTRACT

A cartridge magazine comprising a single piece magazine head having a linearly shaped exterior and an arcuately shaped interior is provided. The magazine head is made by injection molding. The magazine head is connectable to an arcuately shaped magazine body for housing rim fire cartridges. The magazine body is preferably made of two plastic pieces, which are also injection molded. After making each of the halves of the magazine body, they are ultrasonically welded together. The magazine head is then joined to the magazine body. Ultrasonic welding is then utilized to fixedly connect the magazine head to the magazine body.

9 Claims, 5 Drawing Sheets

CARTRIDGE MAGAZINE HAVING A SINGLE PIECE MAGAZINE HEAD

FIELD OF THE INVENTION

This invention relates generally to a cartridge magazine for holding and automatically feeding rim fire cartridges into a firearm and more specifically a magazine which has an arcuate shaped body which is connected to a single piece magazine head.

BACKGROUND OF THE INVENTION

Cartridges for use in firearms are well known. Such cartridges typically comprise a shell, which contains gun powder, and a bullet. The shell comprises a cylindrical casing with a closed end at its base and an open end opposite the base of the shell. If the base extends radially out beyond the casing, the cartridge is termed a "rim fire cartridge." The bullet is secured to the open end of the shell at the end opposite from the base. Magazines for holding cartridges are well known in the art. The magazine can be designed to contain anywhere from a few cartridges to as many as 50 or more cartridges. When the firearm is to be used, the magazine is inserted and secured in the "well" of the firearm. The magazine can be easily detached from the firearm, for instance, to reload the magazine or while the firearm is being stored or transported. The well of a firearm typically has linear, parallel side walls. Therefore, the portion of the magazine which is to be received into the well must also have corresponding linear, parallel exterior walls in order to fit securely within the well. Typically the well also has a latch means which engages corresponding latch engaging means on the magazine so that the magazine can be locked securely in the well.

A problem arises when a large number of rim fire cartridges are stacked in a magazine. Because the diameter of the rim is larger than the diameter of the rest of the cartridge, the cartridges do not line up in a parallel manner when stacked in a magazine. One solution to this problem has been to design magazines that only hold a small number of cartridges (e.g. about seven). In this way, even though the cartridges are not parallel, the total deviation is not too great. However, when it is desired to hold a larger number of cartridges, the variation in cartridge diameter becomes a more pronounced problem. This is because the variation is additive, i.e., when each additional cartridge is stacked in the magazine, the difference in diameter due to the rim forces the adjacent cartridge out of alignment by an additional incremental amount equal to the difference in diameter between the rim and the rest of the cartridge.

This problem has been alleviated by the use of arcuate shaped magazines. The rim of the cartridge is accommodated near the end wall of the magazine which comprises the larger arc segment and the bullet nose points toward the end wall having the shorter arc segment. A typical arcuate shaped cartridge magazine is illustrated in U.S. Pat. No. 4,127,954 to Hausmann. But the use of an arcuate shaped magazine raises another problem because the firearm well is typically not arcuate shaped, but rather linearly shaped. Therefore, the head of the Hausmann magazine which fits into the firearm well is linearly shaped. Because of this modification of the outer surface, it was also necessary to modify the inner configuration of the magazine. In the Hausmann patent, the inner surface of the magazine head has two opposed linearly-extending inner surfaces adjacent to the bullet nose and rim of each cartridge. This necessity of modifying the inner configuration has resulted in many troubles such as the jamming of a cartridge in its translation of movement from an arcuate direction to a linear direction.

In U.S. Pat. No. 4,566,212, to Chesnut, who is also the inventor of the present invention, a cartridge magazine is provided wherein the rim of each cartridge is guided by means so that each cartridge has a continuous arcuate movement throughout the entire extent of the magazine. The magazine has an outer surface which is generally arcuately shaped at one end thereof (which will be termed the magazine "body") and also has an outer surface that is generally linearly shaped at the end that is inserted into the firearm well (which will be termed the magazine "head"). The inner surfaces of the magazine are arcuately shaped and extend throughout the extent of the magazine. Portions of the rim of each cartridge are located in the grooves so that each cartridge moves in an arcuate direction throughout the magazine. This magazine solves the problem of fitting an arcuate shaped magazine into a well with parallel linear walls while at the same time providing continuous arcuate movement throughout the magazine for the cartridge.

However, when it is desired to construct magazines such as those disclosed in U.S. Pat. No. 4,566,212 out of a plastic material, provisions must be made for joining parts of the magazine together. Presently the magazine is made in two separate halves by injection molding. The two separate halves are then joined together by ultrasonic welding. This method of manufacture has worked satisfactorily for magazines designed for various models of firearms. It has recently been discovered, however, that magazines manufactured in this way cannot be accommodated in some firearm wells. The problem is due to the fact that the wells are designed such that the physical dimension difference between the firearm well and the cartridges is slight. In other words, the size of the well is not much larger than the size of the cartridge. The effect of such a small physical dimension difference is that the wall of the magazine head must be quite thin in order to accommodate the cartridge inside the head while still being able to fit within the well. In the past, the solution to this problem has been to design magazines in which both the interior and exterior configuration are linear. In addition, prior art magazines for wells having this slight dimensional difference are typically constructed out of metal, which, because of a higher strength per unit volume ratio than most plastics, allows for thin walls without the loss of structural integrity.

The problem identified by the present invention was how to design and construct a magazine which has an arcuate shaped interior and a head with a linearly shaped exterior, while still being able to fit the head into a well having a very small dimensional difference between the well and the cartridge. Because the arcuate shaped interior does not efficiently fit within the space provided by a linearly shaped exterior, the thickness of the end walls must vary. The thickness of the end walls not only affects the structural integrity of the magazine, but it also affects the method of manufacturing. If the magazine is made of plastic by the prior art method of welding two halves together, the end walls must be greater than a certain minimum thickness in order that the corresponding mating surfaces of the halves are wide enough to weld together. However, this minimum thickness is not available in the end walls of a head designed to fit in a well having only a slight size difference.

Therefore, it would be advantageous to have a magazine with an arcuately shaped interior and having a head portion which has a linearly shaped exterior which is able to fit within a linearly shaped firearm well having a slight dimensional difference between the well and the cartridge. It would also be advantageous to construct such a magazine from plastic and yet maintain the structural integrity of the magazine.

SUMMARY OF THE INVENTION

The present invention comprises a magazine head manufactured as a single piece, preferably of plastic. By manufacturing the head as a single piece, the need for ultrasonic welding two halves of the magazine head together is eliminated. The head has a linearly shaped exterior. It is connectable with a magazine body, and together, the head and body provide a continuous arcuate configuration throughout the interior of the magazine.

The cartridge magazine formed from the magazine head and the magazine body is provided for preferably housing a number of rim fire cartridges. The magazine body is manufactured separate from, yet is attachable to, the magazine head. The magazine body has a first connecting member provided adjacent to the top portion of the body which engages a second connecting member on the magazine head. The second connecting member is provided adjacent the bottom portion of the head. Both the magazine head and body are preferably made of a plastic material.

In making the cartridge magazine, a first half of the magazine body and a second half of the magazine body are each separately made by injection molding. The halves are then joined together by ultrasonic welding. The magazine head is made separately by injection molding and then the magazine head and magazine body are joined together using the first and second connecting members. Subsequently, the magazine body and the magazine head are immovably connected by ultrasonic welding.

The advantage of such a magazine is that it can be constructed of a plastic material, it can hold a large number of cartridges and yet it can fit within a firearm well in which there is a slight size difference between the length of the cartridge used with the firearm and the distance across the well for receiving the magazine containing such cartridges.

DETAILED DESCRIPTION OF THE INVENTION

Figure 1:
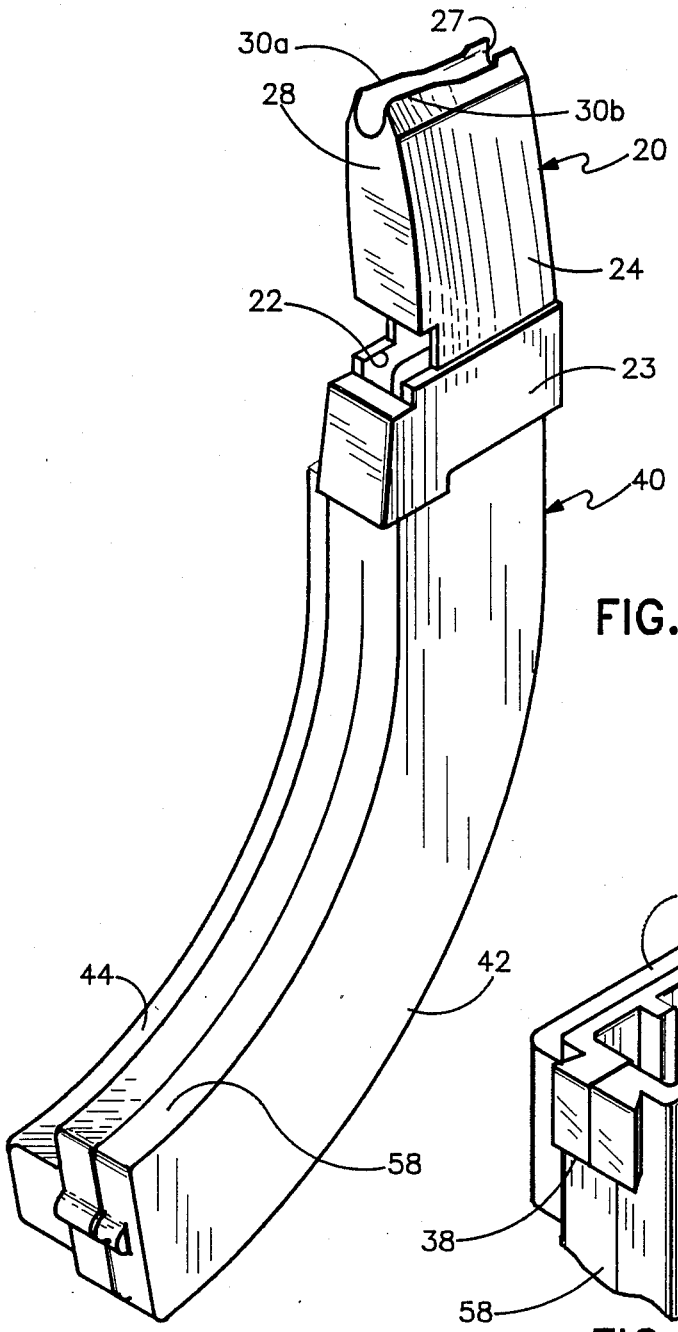
FIG. 1 is a perspective view of a preferred embodiment of the magazine of this invention.
Figure 2:
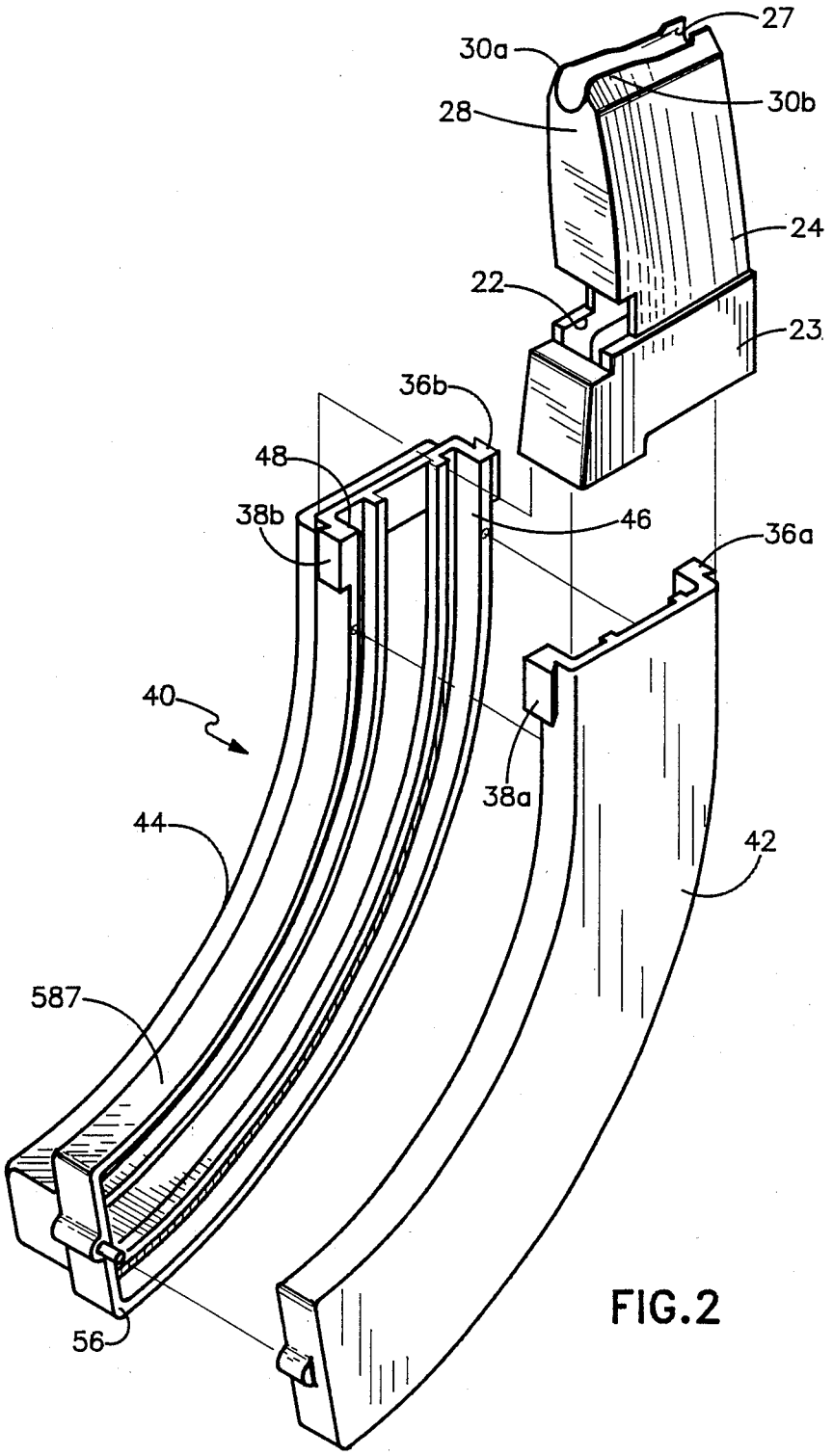
FIG. 2 is an exploded view of the magazine shown in FIG. 1.
Figure 8:
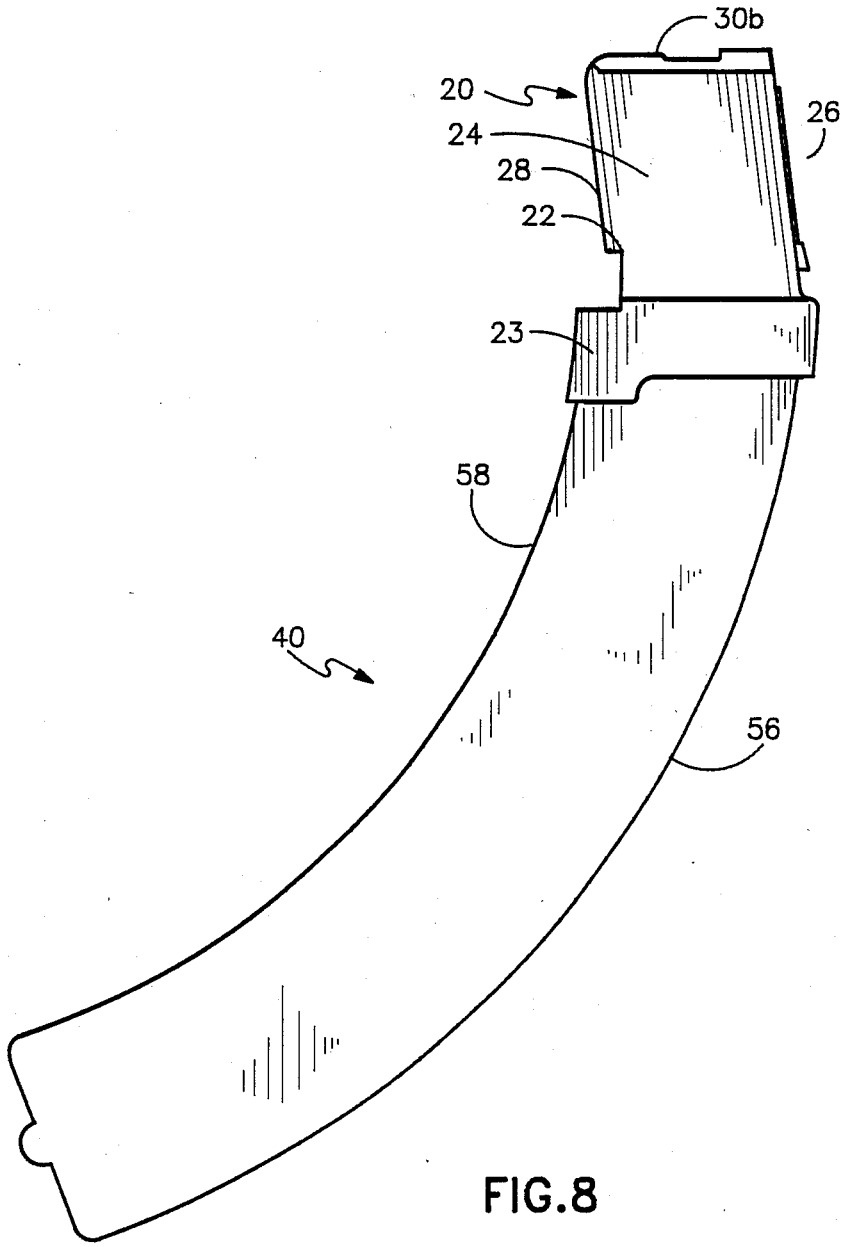
FIG. 8 is a side elevational view of the magazine shown in FIG. 1.
Figure 9:
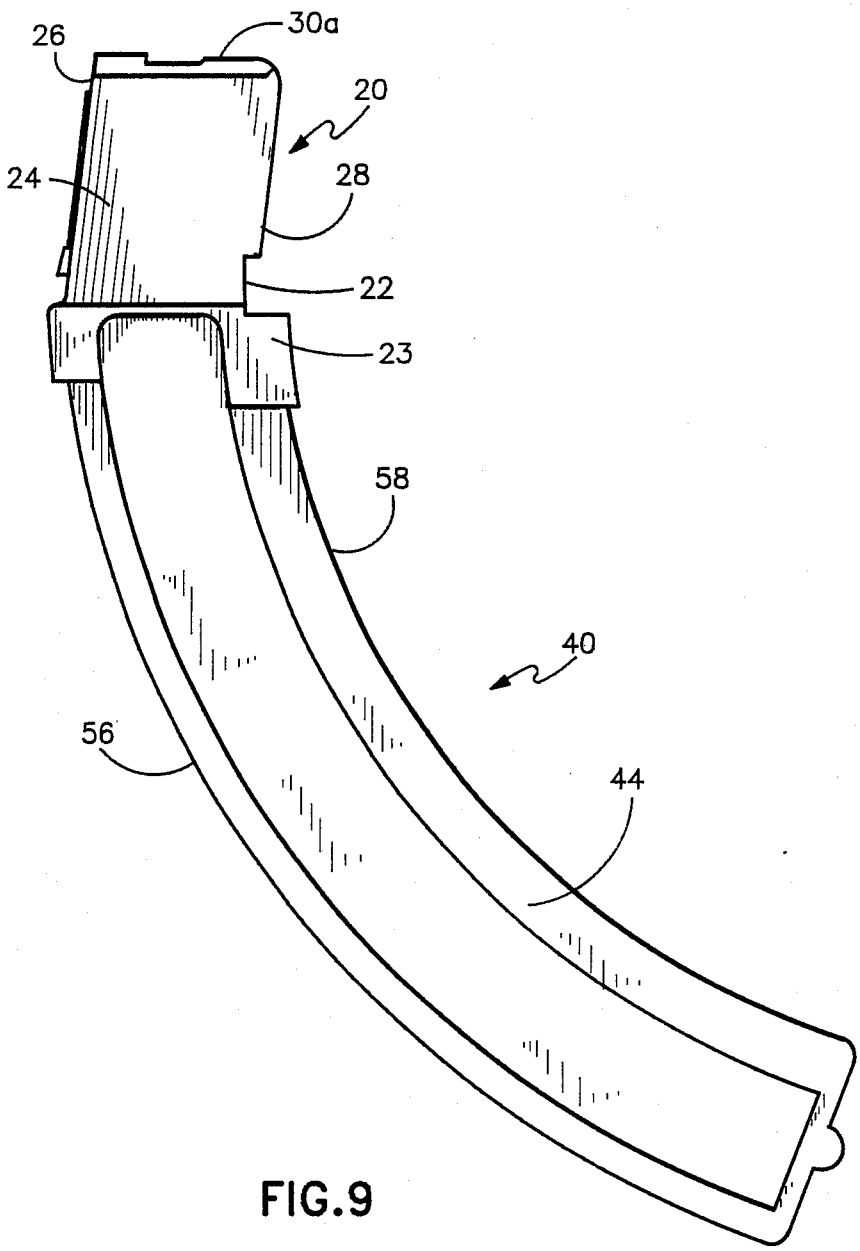
FIG. 9 is a side elevational view of the magazine shown in FIG. 1.

The cartridge magazine of this invention as illustrated in FIG. 1 comprises a magazine head 20 which is connectable to a magazine body 40. The magazine head 20 includes a skirt 23 and an upper member 24 extending from the skirt 23. The upper member 24 terminates in an opening 27 defined by a pair of lips 30*a*, 30*b*, which are located at the top of the upper member 24. As seen in FIGS. 1, 8 and 9, the skirt 23 overlaps or surrounds outer, upper portions of the magazine body 40. As shown in FIG. 2, the magazine body 40 preferably comprises two halves 42, 44. When assembling the magazine, the halves 42, 44 of the magazine body 40 are first connected together and then the magazine head 20 is connected to the magazine body 40.

Figure 3:
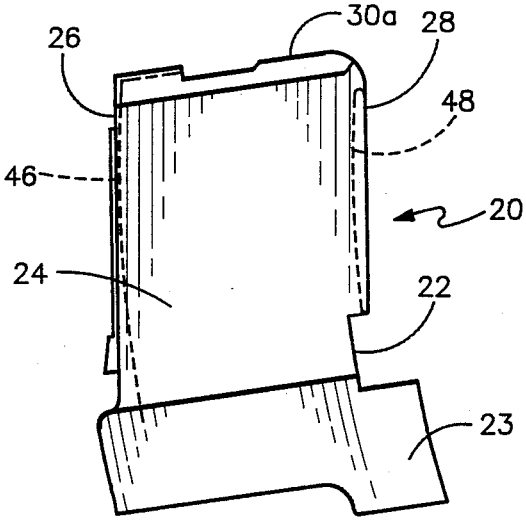
FIG. 3 is a side elevational view of the magazine head.
Figure 4:
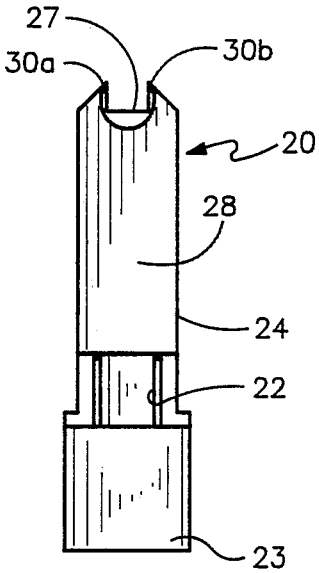
FIG. 4 is an end elevational view of the magazine head.
Figure 5:
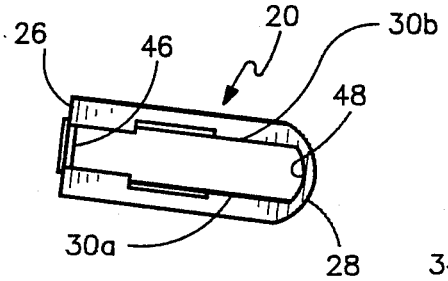
FIG. 5 is a top elevational view of the magazine head.

Side views of the assembled magazine are shown in FIGS. 8 and 9. When assembled, in one embodiment, the magazine has substantially the same interior configuration as the magazine disclosed in U.S. Pat. No. 4,566,212 issued Jan. 28, 1986, to M. Gaines Chesnut, which is hereby incorporated by reference in its entirety. The interior configuration is substantially arcuate throughout the magazine. In the magazine body 40 as seen in FIG. 2, the interior end walls 46, 48 are substantially the same distance or separation from their respective exterior end walls 56, 58 throughout the longitudinal extent of the interior end walls 46, 48. This is not true for the magazine head 20. With reference also to FIG. 3, the linearly shaped exterior end walls 26, 28 of the magazine head 20 are not the same distance from the arcuately shaped interior end walls 46, 48 of the magazine head 20, which end walls constitute a continuation of the interior end walls of the magazine body 40. Depending on the model or make of firearm with which the magazine of the present invention will be used, the thickness of the end walls of the magazine head 20 will vary along their longitudinal extent. In the embodiment shown, the magazine head 20 has a notch 22 located at a lower portion of the end wall 28 of the head 20 whereby the end wall thickness is non-existent. This configuration of magazine head 20 is used with certain models of Marlin firearms.

The exterior end walls 26, 28 of the magazine head extend in a linear fashion. This allows the magazine head 20 to be inserted into the well of a firearm (not shown) having straight and parallel end walls. The head 20 is constructed of a single piece of material, preferably plastic. This eliminates the need for connecting two halves of a head together along a line extending longitudinally through the center of the end walls, as is disclosed in U.S. Pat. No. 4,566,212. By eliminating the need to connect, e.g. by ultrasonic welding, the halves of the magazine head together at the end walls, it is possible to manufacture a head with end walls having minimal thickness. That is, it is not possible to make, by injection molding, two separate halves of the magazine head and then ultrasonically weld them together because of the lack of thickness along the longitudinal center line of the magazine head end walls.

Figure 7:
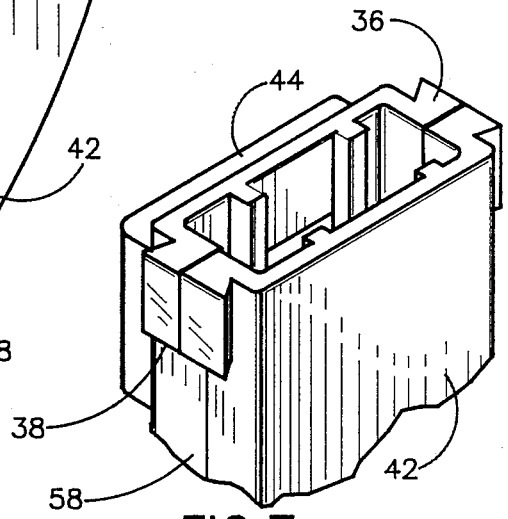
FIG. 7 is an enlarged, fragmentary perspective view of the top of the body of the magazine with the magazine head removed.
Figure 6:
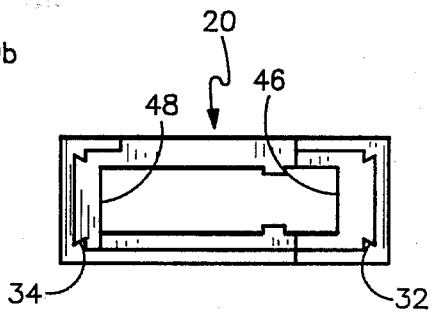
FIG. 6 is a bottom elevational view of the magazine head.

Adjacent to the lower portion of the magazine head 20 are connecting members. The connecting members provide desired alignment between the end walls of the magazine body 40 and the end walls of the magazine head 20, as well as assisting in maintaining the halves 42, 44 of the magazine body together. Preferably these connecting members comprise dovetail joints. As shown in FIG. 6, which is a bottom elevational view of the magazine head 20, female dovetail joints 32, 34 are provided adjacent to the bottom of the magazine head and adjacent to the interior end walls 46, 48 of the magazine head 20. Corresponding male dovetail joints 36, 38 are provided adjacent the upper portion of the magazine body 40 and adjacent to the exterior body end walls 56, 58, as shown in FIG. 7. When the magazine body 40 is made of separate pieces 42, 44 as illustrated in FIG. 2, the male dovetail joints 36, 38 also initially comprise two separate halves, as shown by 36*a*, 36*b*, and 38*a*, 38*b*, respectively.

When the magazine is assembled, the two halves of the magazine body 42, 44 are first connected together, thereby forming a unitary body 40 having two male dovetail joints 36, 38. Next the male dovetail joints 36, 38 provided adjacent to the top of the magazine body 40 are engaged with the female dovetail joints 32, 34 provided adjacent the bottom of the magazine head 20 to form the unitary magazine shown in FIG. 1. By employing dovetail joints in this manner, the two halves 42, 44 of the magazine body 40 are forced together while proper alignment of the interior end walls 46, 48 of the head 20 and body 40 is simultaneously achieved. It should be understood that connecting members other than the dovetail pieces could be employed such as, for example, connecting pins.

In making the magazine, each of the magazine body halves 42, 44 is separately manufactured by injection molding including the necessary connecting member located at the top of each half 42, 44. The magazine head 20 is also separately made by injection molding including its connecting member. The two halves 42, 44 are fixedly connected together by ultrasonic welding along the longitudinal center line of the two joined halves 42, 44. The magazine head 20 is then joined to the connected halves of the magazine body 40 using the connecting members. To immovably connect the magazine head 20 to the magazine body 40, they are ultrasonically welded together along the top portion of the magazine body 40 and the bottom portion of the magazine head 20. It should be understood that the permanent connection could be accomplished by means other than ultrasonic welding such as, for example, cementing, snap fitting and using connecting pins.

The magazine of the present invention is especially well suited for use in firearms that have wells having a size only slightly greater than the length of the cartridges used with the firearms. Examples of such firearms include, but are not limited to, models manufactured by Marlin, Arms Corporation, Anschutz, Auto Ordnance, Federal, Interarms, Mitchell, and Voere. It should also be understood that magazines can be provided according to the present invention for holding a large number of cartridges, such as fifty cartridges, and the magazine body and head designs need not be limited to the specific design illustrated in the figures.

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A magazine for housing a number of cartridges, comprising:

a magazine body for containing a number of cartridges and including a pair of sidewalls and a pair of end walls with said sidewalls having a greater lateral dimension than the lateral dimension of each of said end walls and said magazine body having a longitudinal extent with said sidewalls and said end walls having upper portions;

a magazine head having a longitudinal extent less than said longitudinal extent of said magazine body, said magazine head being made separately from said magazine body, wherein said magazine head includes a skirt having a lateral dimension extending in a direction across said magazine body sidewalls and an upper member having a lateral dimension substantially parallel to said skirt lateral dimension, said skirt being disposed about and outwardly of said upper portions of said magazine body end walls to overlap said upper portions of said end walls, said upper member lateral dimension being less than the lateral dimension of said magazine body side walls throughout substantially all of said longitudinal extent of said upper member; and means for connecting said magazine body to said magazine head.

2. The magazine of claim 1 wherein said means for connecting includes:

a first connecting member provided adjacent to a top portion of said magazine body; and a second connecting member provided adjacent to a bottom portion of said magazine head.

3. The magazine of claim 1 wherein said magazine head has a substantially linearly shaped exterior.

4. The magazine of claim 1 wherein said magazine head includes end walls having a thickness that varies along said longitudinal extent of said magazine head.

5. The magazine of claim 1 wherein said magazine head end walls have lower portions in which one of said end wall lower portions includes a notch exposing the interior of said magazine head.

6. The magazine of claim 2 wherein said first connecting member and said second connecting member comprise male and female dovetail joints in which said dovetail joints are disposed only on said end walls of said magazine body and said magazine head.

7. The magazine of claim 1 wherein said cartridges are rim fire cartridges.

8. The magazine of claim 1 wherein said magazine body includes two halves fixedly joined together.

9. A magazine for housing a number of cartridges, comprising:

a magazine body for containing cartridges and having a longitudinal extent and a lateral extent;

a magazine head having a longitudinal extent less than said longitudinal extent of said magazine body and a lateral extent, said magazine head being made separately from said magazine body, wherein said lateral extent of said magazine head is less than said lateral extent of said magazine body throughout substantially major portions of said longitudinal extent of said magazine head; and means for connecting said magazine body to said magazine head, wherein said magazine head and said magazine body are connected together by moving at least one of said magazine body and said magazine head in a direction substantially parallel to said longitudinal extent of said magazine head until said magazine head engages said magazine body using said means for connecting.

* * * * *